US007421242B2

(12) United States Patent
Wolf et al.

(10) Patent No.: US 7,421,242 B2
(45) Date of Patent: Sep. 2, 2008

(54) DEVICE FOR POST-PROCESSING OF A PRINT SUBSTRATE WEB PRINTED BY AN ELECTROGRAPHIC PRINTING OR COPYING DEVICE

(75) Inventors: Roland Wolf, Unterhaching (DE); Franz Wittmann, Isen (DE); Said Youzbachi, München (DE); Günther Eder, München (DE); Murat Kader, München (DE)

(73) Assignee: Oce Printing Systems GmbH, Poing (DE)

( * ) Notice: Subject to any disclaimer, the term of this patent is extended or adjusted under 35 U.S.C. 154(b) by 321 days.

(21) Appl. No.: 11/223,539

(22) Filed: Sep. 9, 2005

(65) Prior Publication Data

US 2006/0109303 A1 May 25, 2006

(30) Foreign Application Priority Data

Nov. 19, 2004 (DE) ..... 10 2004 056 000

(51) Int. Cl.
*G03G 15/00* (2006.01)

(52) U.S. Cl. ..... 399/407

(58) Field of Classification Search ..... 399/407, 399/341

See application file for complete search history.

(56) References Cited

U.S. PATENT DOCUMENTS

| | | | | |
|---|---|---|---|---|
| 3,871,081 | A | 3/1975 | Inoue et al. | |
| 4,089,738 | A | 5/1978 | Kankaanpaa | |
| 4,639,405 | A * | 1/1987 | Franke | 399/331 |
| 4,938,786 | A | 7/1990 | Tonomoto | |
| 5,694,638 | A | 12/1997 | Maruyama et al. | |
| 5,805,969 | A | 9/1998 | Elsermans et al. | |
| 5,937,258 | A * | 8/1999 | Acquaviva et al. | 399/341 |
| RE36,963 | E * | 11/2000 | Ando et al. | 399/343 |
| 6,249,667 | B1 | 6/2001 | Acquaviva et al. | |
| 2004/0005178 | A1 | 1/2004 | Frohlich | |
| 2004/0067081 | A1 | 4/2004 | Kasahara | |
| 2004/0067082 | A1 * | 4/2004 | Uehara et al. | 399/341 |

FOREIGN PATENT DOCUMENTS

| | | |
|---|---|---|
| DE | 25 22 965 | 12/1975 |
| DE | 20 34 955 | 8/1978 |
| EP | 0 271 836 | 6/1988 |
| EP | 0 758 766 | 2/1997 |

* cited by examiner

*Primary Examiner*—David M. Gray
*Assistant Examiner*—Ryan D. Walsh
(74) *Attorney, Agent, or Firm*—Schiff Hardin LLP

(57) ABSTRACT

A device for post-processing of printed print substrate webs comprises a smoothing device that is arranged immediately after the fixing device. The toner (still hot and doughy in terms of its consistency) is compressed with a predetermined pressure over a width of the print substrate web. It is thus achieved that less abrasion of the toner occurs in the further process and a specifically altered print image is generated.

16 Claims, 8 Drawing Sheets

DEVICE FOR POST-PROCESSING OF A PRINT SUBSTRATE WEB PRINTED BY AN ELECTROGRAPHIC PRINTING OR COPYING DEVICE

BACKGROUND

The preferred embodiment concerns a device for post-processing of a print substrate web printed by an electrographic printing or copying device in which toner is transfer printed onto a print substrate as a print image and subsequently fixed.

Such a device is, for example, known from the patent document EP 0 758 766 B1. There the printed print substrate web is initially guided through a fixing device. In a subsequent post-processing device, gloss and color saturation are conferred to the print image. For this, the print substrate web is first cooled after the fixing device and then directed through smoothing rollers that, for their part, are heated in order to smooth the toner in order to achieve a predominantly smooth surface. The print substrate web with the toner is subsequently re-cooled in order to feed the printed and fixed print substrate web to a subsequent end-processing (finishing).

In a further known device (U.S. Pat. No. 6,249,667) for post-processing of a print substrate web printed by an electrographic printing or copying device, a dampening or moistening device is arranged after a fixing device in the feed direction of the print substrate. A fluid film is applied on the fixed image with the dampening device, whereby a gloss dependent on the quantity of the fluid is conferred to the print image and the paper. With this dampening device, the toner is merely dampened but not smoothed.

In another known device (U.S. Pat. No. 5,694,638) for post-processing of a print substrate web printed by an electrographic printing or copying device, a controllable transport device is arranged at the print substrate output of the printing or copying device. The transport device is regulated relative to the transport speed so that a crumpling of the print substrate is prevented, since the print substrate is always held under tension. The transport device is also designed so that the print image is not influenced.

In electrographic printing, the print toner images (generated on the print substrate) of the images to be printed are fixed in the printing device and thus permanently bound with the print substrate. Such methods are sufficiently known (see, for example, US 2004/005178 A1) and are therefore not described in detail here. The fixing can thus occur in various manners, for example via roller fixing under pressure and heat or via radiation fixing under heat. With regard to the individual known techniques, reference is likewise made to the disclosure document US 2004/005178 A1 already cited before.

In the fixing, the print substrate web is exposed to heat and, if applicable, pressure, with the result that the properties of the print substrate such as, for example, dampness and sliding properties are negatively influenced. In particular, however, poor sliding properties of the print substrate can lead to the fixed toner layer being mechanically damaged or smeared in the post-processing. For post-processing, the print substrate web is therefore improved in terms of its sliding properties in the known device, in that the print substrate web is lightly dampened.

Such a dampening device is proposed in the German patent application DE 10 2004 002232.1-51 (not yet published). What is disadvantageous in this method and in the previously cited known methods is that the dampening only acts for a short time. The abrasion already noticeably increases again within a few hours. Pauses in the range of hours to days between printing and post-processing frequently occur in operation. Furthermore, the paper transport in the end processing is impaired by the slip agent lubricant. In some systems this leads to increased outage times.

SUMMARY

It is an object to achieve a device for post-processing of a print substrate web printed by an electrographic printing or copying device, in which a permanent improvement of the abrasion resistance of the print image is achieved.

In the method or device for post-processing of a print substrate web printed in an electrographic printing or copying device, a smoothing device is arranged in immediate proximity after a fixing device in a feed direction of the print substrate web. The smoothing device substantially presses a toner flat with a predetermined pressure.

DESCRIPTION OF THE PREFERRED EMBODIMENT

Figure 1:
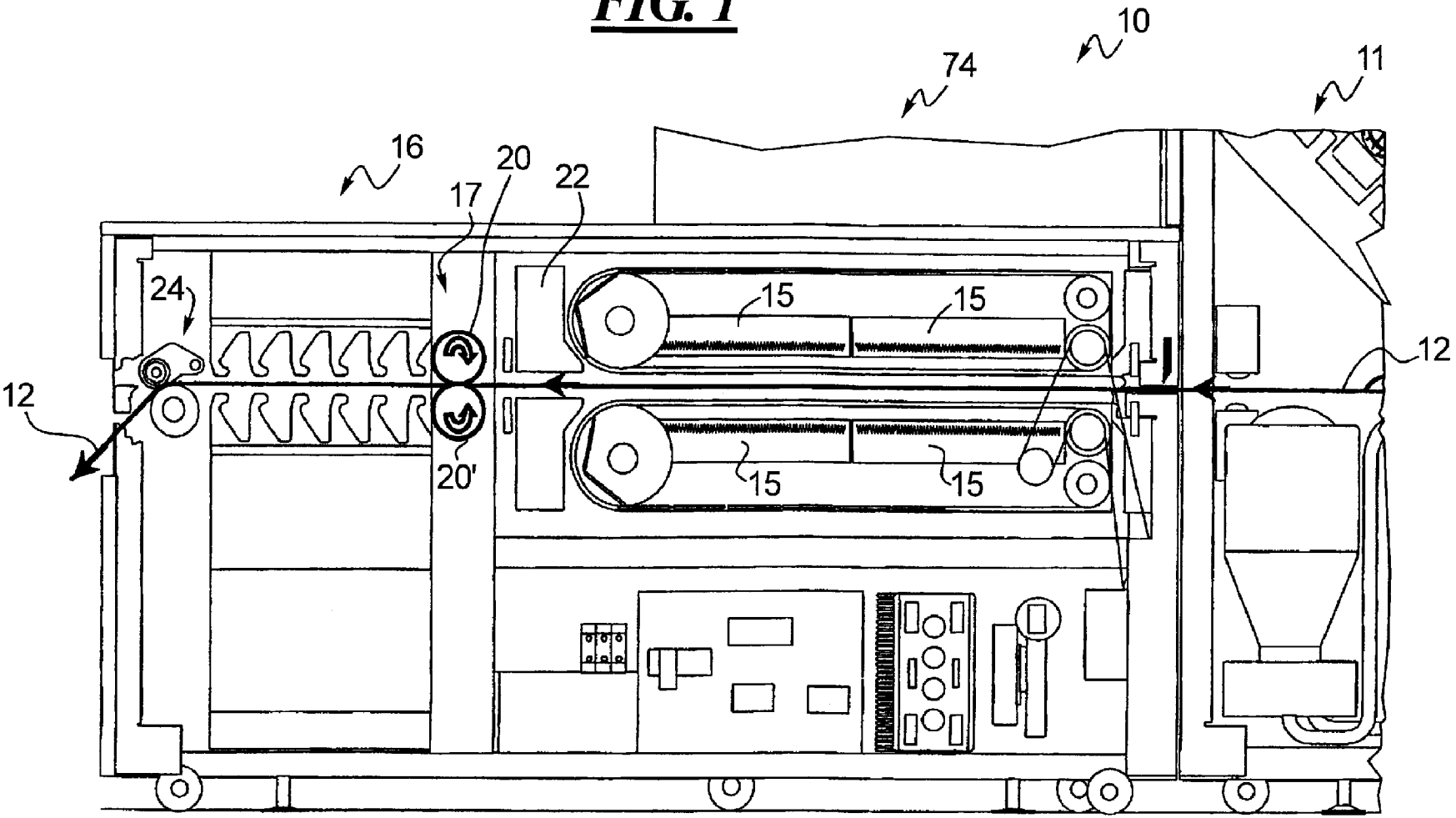
FIG. 1 is a view of a part of an electrographic printing or copying device with a fixing station, a subsequent smoothing device and a print substrate web cooling.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

With the preferred embodiment, pressure is applied with a certain nip on the hot and doughy toner, and the toner with its "toner mountain" is leveled as well as compressed, a permanent improvement of the abrasion resistance thus being achieved. A targeted cooling of the toner may not occur before the smoothing device since otherwise no permanent leveling occurs, or the toner is already too cold in order to still be sufficiently smoothed. Since the still-hot and not significantly cooled toner is smoothed, leveled and compressed by the smoothing device, only a slight surface pressure on the print image surface of the print substrate web is necessary, which leaves the print substrate web appearing as if treated carefully and the toner image appears cleaner. The surface of the print image and thus the toner are compressed by the uniform smoothing. However, the toner may not thereby be smoothed so far that the print characters are broadened or shifted in their outer dimensions. The smoothing and compression additionally has the advantage that a dampening substance applied on the print image does not drain away and the abrasion in the further course is significantly reduced.

The smoothing device may comprise a cleaning device in order to remove dirt/dust particles or toner still located on the smoothing device that have undesirably attached on the smoothing roller. It is particularly advantageous to also design the cleaning device as a dampening device. Since the cleaning device is in direct contact with the smoothing device, a dampening agent (such as, for example, silicon oil) is applied on the print substrate web simultaneously with the smoothing. Since the toner is smoothed and simultaneously oiled, only a slight oil quantity is required that then remains adhered on the surface longer. When the cleaning device is no longer in direct contact with the smoothing device during downtime of the printing operation, this has the advantage that the dampening substance cannot deposit accretions on the smoothing device.

The cleaning device is advantageously provided with a cleaning belt that is saturated with the dampening substance, whereby the cleaning belt glides along a surface of the smoothing device to be cleaned and thus cleans and (advantageously) dampens the smoothing device. A compact unit is thus achieved that simultaneously effects a cleaning of the smoothing device and a dampening of the print substrate web in the most narrow space.

An air suction via which moisture (in particular ink vapor, water vapor and dust particles) are drawn off can be arranged between the fixing device and the smoothing device. Essentially no cooling of the toner occurs via this suction device, so that the toner is not significantly cooled and the toner can subsequently be well-smoothed and leveled in the smoothing device.

The smoothing device is advantageously formed by two cylindrical smoothing rollers that are arranged parallel to one another and between which the print substrate is directed. Both the front side and the back side of the print substrate can thus be in contact with the smoothing rollers and the toner can correspondingly be smoothed after the fixing. Also, the printed print substrate can be post-processed on only one side by such a smoothing device. However, for one-sided printing it is also possible to use only a single smoothing roller, whereby this must comprise a mechanical part applying a counter-force as a counter-bearing. The print substrate web should be able to glide well over the mechanical part. This part is advantageously designed as a freely-rotatable cylindrical roller.

The smoothing device can comprise at least one essentially cylindrical smoothing roller whose outer surface is comprised of a hard outer layer whose outer cylindrical generated surface is additionally two-dimensionally or three-dimensionally profiled. A spatial structure can thus be impressed on the fixed toner, via which the gloss of the print image can be varied.

Such a smoothing roller is advantageously produced from a hard outer layer, an optional, soft intermediate layer and a hard inner core. The outer layer is thus significantly more heat-conductive than the intermediate layer which, for its part, represents a thermal insulation. The heat on the generated surface of the smoothing roller is thereby well and quickly distributed across the entire generated surface. Predominantly the same conditions thus prevail over the entire print image. Since heat transfers from the hot toner to the outer layer, the thin outer layer with good thermal conductivity also quickly reaches operating temperature.

The outer layer is advantageously produced from a heat-conductive fluoride polymer such as PFA (perfluoralcylvinylether) or a shrink tubing, the intermediate layer from a silicon compound (silicone rubber) and the inner core completely or hollow-cylindrically from steel.

The cleaning device advantageously comprises a foam material roll as an overcoat over a guide roller for a cleaning belt. The foam material roller is spring-borne and elastically presses the cleaning belt against the smoothing roller, whereby the cleaning roller is cleaned. The foam material roller is only in effective connection with the smoothing roller via the cleaning belt in the printing operation. Cleaning belt and smoothing roller are separated from one another in the rest state. This can be effected via swinging away the smoothing roller and/or the cleaning unit.

When the smoothing roller is designed circularly-cylindrical and slightly convex (straight-barrel-shaped), the pressure on the print substrate web is increased in the region of the middle of the roller so that, as a counteragent to the deflection of the rollers, (the rollers are borne on the front side), the pressure is approximately uniformly distributed over the width of the print substrate web. If, in contrast to this, the smoothing roller is designed slightly concave in the axial direction, the print substrate web can be drawn outwards on its outer edge and thus tensed. In order to further improve the paper run stability and to simultaneously achieve a good smoothing effect, it can also be advantageous to have concave and convex sections alternate in the axial direction.

In electrographic printing or copying devices 10 (FIG. 1) for one-sided or double-sided printing in black-and-white and/or color, the print image generation occurs, for example, with an LED character generator and a corresponding developer. Instead of the electrophotographic printing process with LED character generators, other electrographic printing principles such as electrolytic, photoflash or magnetic electrography methods can also be used.

In the electrophotographic printing method (also designated as xerography), a photoconductor (not shown; in the form of a drum or a belt) in a printing station 11 (here shown only in part) is provided with a toner image via electrical discharge by means of light by electrostatic methods. In a transfer printing device (not shown), the toner image is then electrostatically transferred onto a transfer belt (likewise revolving continuously) or directly onto the print substrate (for example paper, plastic film or metal film). The transfer onto a print substrate web 12 occurs at the transfer printing point "transfer belt/print substrate". The upper and lower print substrate web sides are transfer printed simultaneously or in succession in the case of the double-sided printing operation.

The toner image is subsequently fixed in a fixing station 14 (the toner image is also designated as a print image 21). The fixing of the toner image on the print substrate can occur simultaneously or in temporal succession by means of an infrared radiation fixing for one-sided and double-sided printing operation. For this, the infrared fixing station 14 comprises one or more radiator modules 15 that heat the toner to a predetermined temperature via radiant heat and thus melt the toner onto print substrate web 12.

The print substrate web 12 is transported through the post-processing station 16 with actuation of the printing station (only partially shown) and a paper feed at the end of the post-processing station 16. Since fixing stations (and in particular IR fixing stations) are sufficiently known, nothing more of them will be discussed in detail in the following specification.

According to the preferred embodiment, a smoothing device 17 (shown significantly simplified in FIG. 1, without an actuation and displacement mechanism) that smoothes the toner image fixed by the fixing station 14 is arranged immediately after the fixing station 14 in the transport direction of the print substrate web (see arrows in FIG. 1). For this it is utilized that, after leaving the fixing station, the toner is still so hot that this temperature clearly lies above the glass transition temperature for the corresponding toner. The consistency of the toner is still doughy. Due to the fixing under significant heat, the surface of the toner exhibits a "mountainous" surface.

The toner can now be smoothed as well as compressed as desired on the entire width of the print substrate web 12 by means of the smoothing device 17 since its consistency is still doughy or viscous. The smoothing preferably occurs with smoothing rollers 20, 20'. Only two smoothing rollers 20, 20' are schematically shown in the operating state in FIG. 1, whereby the print substrate web 12 is guided between the two smoothing rollers 20, 20'.

After the fixing station 14 and before the smoothing device 17, an air suction or in particular a hot air suction 22 can be arranged that draws off dust, water vapor or ink vapor. It is thereby prevented that any particles deposit on the toner and lead to a degraded print image 21. In the event that the hot air suction 22 is event necessary, it may, however, barely affect the toner in terms of its temperature (i.e. not significantly cool the toner).

After the smoothing device 17, the print substrate web 12 is cooled on each side by a cooling device 23 (for example by means of air nozzles) that blow cold air against the print substrate web 12. The print substrate web 12 is subsequently drawn from the cooling device 23 with the aid of a print substrate web puller 24 and supplied to an end processing unit (not shown; for example with a cutter, a binder, a stacker, an enveloper etc.).

Figure 2:
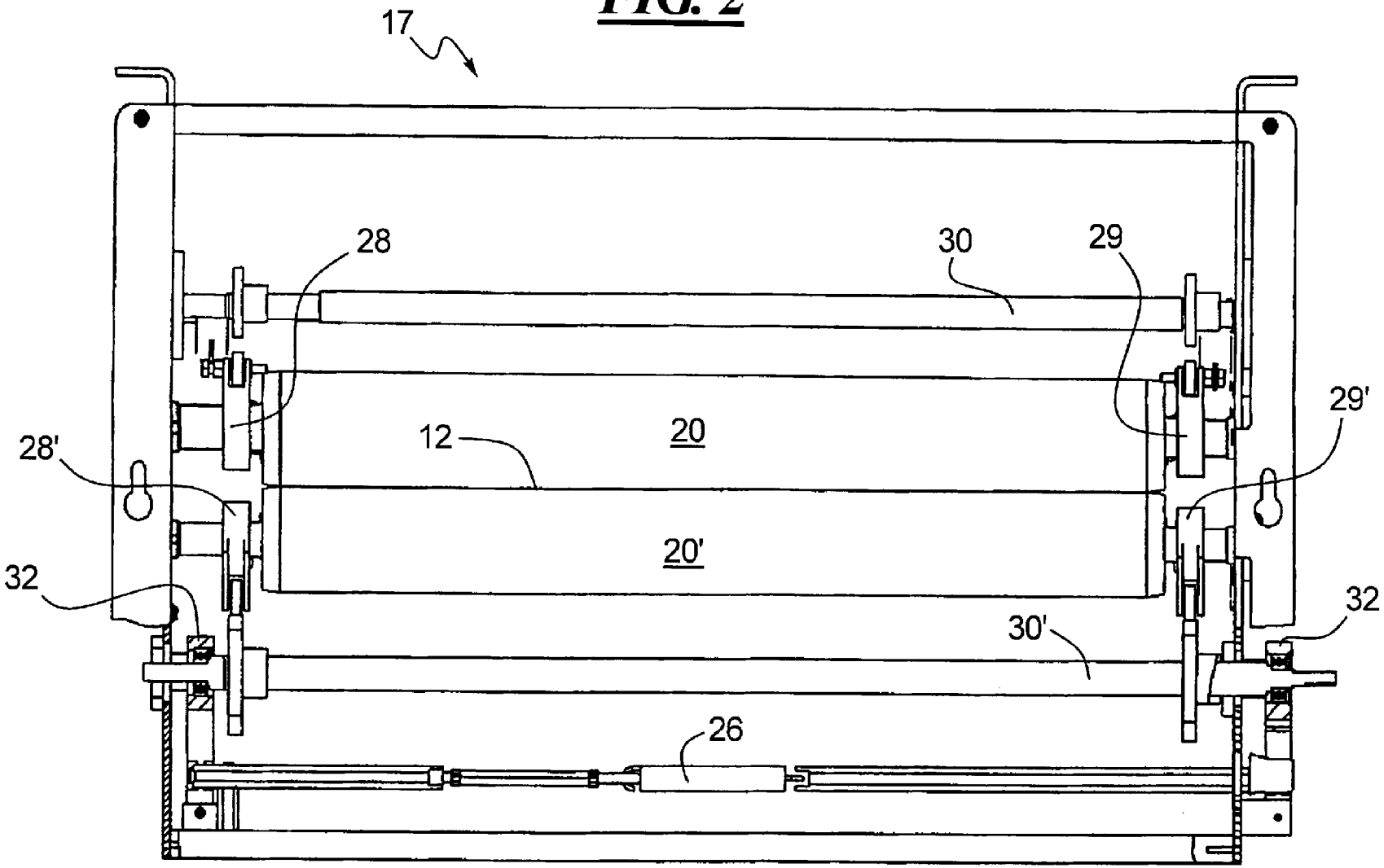
FIG. 2 shows in an operating state, a front view of a device for post-processing of a print substrate web printed by an electrographic printing or copying device.

A simplified view of the smoothing device 17 is shown in FIG. 2. The smoothing device 17 is thereby located in a working position or in an operating state, meaning that the print substrate web 12 is in effective connection with the smoothing device 17. Two freely-rotatable smoothing rollers 20, 20' are arranged parallel to one another. The print substrate web 12 is directed between the two smoothing rollers 20, 20'. The smoothing rollers 20, 20' are borne such that they can shift or pan in the direction of the print substrate web 12, such that they can be moved away from the print substrate web 12 in the rest state (compare FIG. 4) and thus be held at a distance from this. In contrast to this, in the operating state the smoothing rollers 20, 20' press the print substrate web 12 guided between them together and thereby smooth the still-hot toner.

Figure 5:
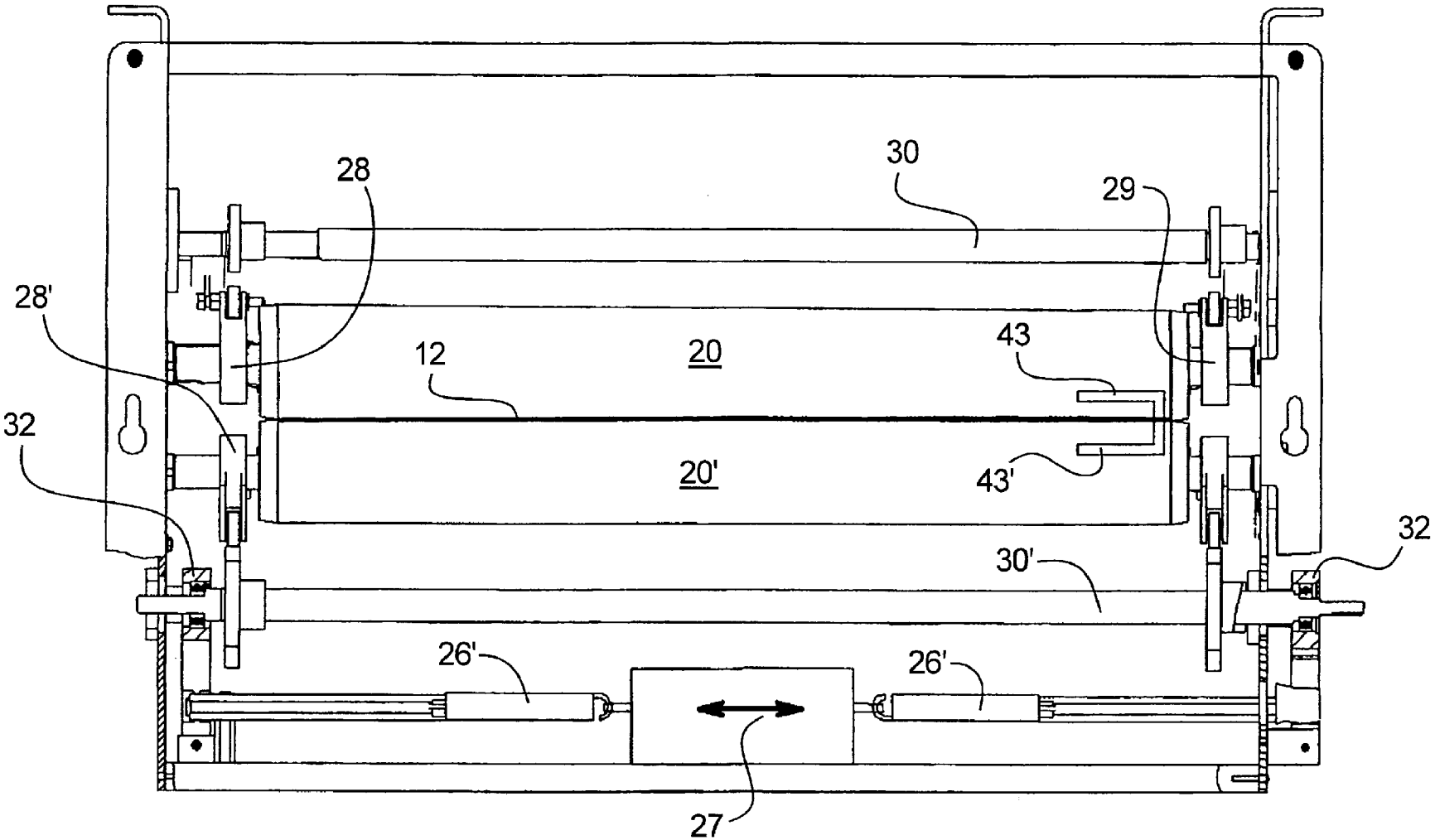
FIG. 5 is a view of the device according to FIG. 2 with a drive element instead of a spring for pressing cleaning rollers against smoothing rollers.

For smoothing, mechanical pressure on the smoothing rollers 20, 20' is exerted so that these lie on the print substrate web 12 with a nip and with a predetermined force/pressure optimally distributed uniformly, transversely across the print substrate web 12, and press on this print substrate web 12 in order to smooth and compress the toner image over the entire width of the web. This pressure can be exerted by a spring 26 or—as shown in FIG. 5—by an electromotive component (actuating element 27) together with further springs 26'.

The smoothing rollers 20, 20' are borne such that they can rotate freely and are situated on moving pivot arms 28, 28' which can be moved/pivoted into different positions via lifter actuators. (lifter drivers) 30, 30'. The upper lifter actuator 30 is permanently borne in a housing (not shown); in contrast to this, the lower lifter actuator 30' is borne in a housing with two spring-borne, pre-stressed pre-stress levers 32 on both sides. The pre-stress levers 32 are connected via a tension element and deflectors (baffles) with the common spring 26 so that equal and optimally symmetrical pressing forces develop on both sides of the lower smoothing roller 20' and a uniform surface pressing is therewith generated on the print image 21. The lower smoothing roller 20' is thus pressed against the upper smoothing roller 20 via elastic force.

When the smoothing rollers 20, 20' are designed circular-cylindrical, they should have a significant axial longitudinal rigidity so that they "sag" only slightly given the two-sided bearing and the pressure of the two smoothing rollers 20, 20' against one another is optimally uniformly, axially distributed.

Figure 3:
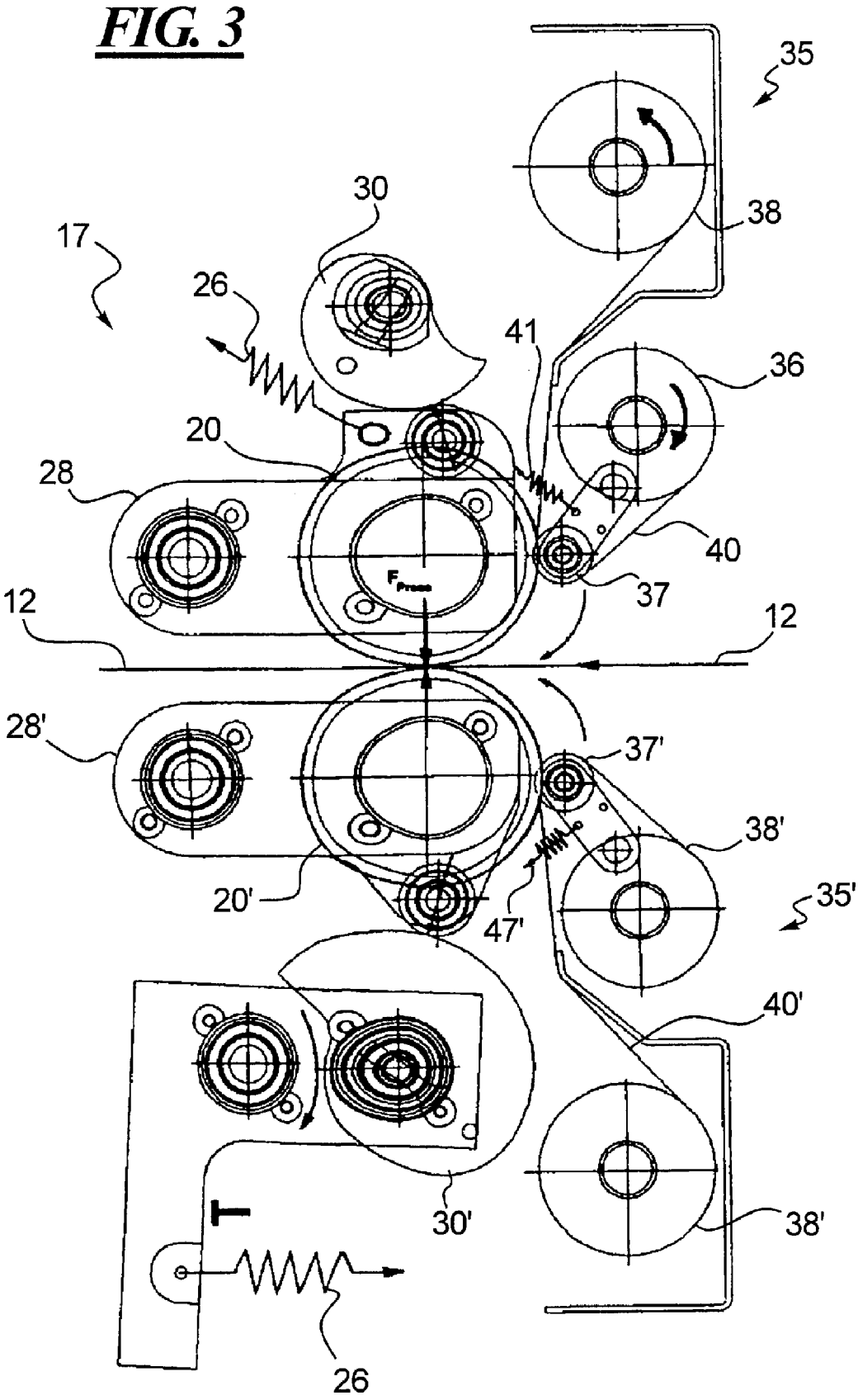
FIG. 3 illustrates a side view (or section) of the device according to FIG. 2.

In FIG. 3, how the smoothing rollers 20, 20' are elastically pressed against the print substrate web 12 in the operating step is clearly recognizable in a schematized side view of the smoothing device 17 of FIG. 2. The smoothing rollers 20, 20' thereby respectively apply the force $F_{press}$ (see force arrow in FIG. 3.). The print substrate web 12 is moved from right to left in FIG. 3 and thereby correspondingly drags (tows) the smoothing rollers 20, 20' along so that the upper smoothing roller 20 rotates clockwise and the lower smoothing roller 20' rotates counter-clockwise.

An optional cleaning device 35 that comprises a dispenser roller 36, a pressure roller 37 and a winding roller 38 is additionally shown in FIG. 3. A belt-shaped, soft cleaning felt (cleaning belt 40) is used as a cleaning unit that unwinds in the transport direction from the dispenser roller 36 and is pressed against the smoothing roller 20 by the pressure roller 37 cushioned with a spring 41. Driven with a slow speed by an electromotor (not shown) and guided by the pressure roller 37 as a guide roller, the cleaning belt 40 is drawn past the smoothing roller 20 and thereby cleans the smoothing roller 20. The used cleaning belt 40 is wound on the winding roller 38.

The pressure roller 37 advantageously comprises a soft layer (for example foamed material) on its external circumference and is elastically pressed against the smoothing roller 20 with the aid of the spring 41 so that the cleaning belt 40 comes into contact with the entire surface of the smoothing roller 20, even when the surface exhibits unevenness.

In double-sided printing (duplex), a respective smoothing roller 20, 20' and a respective cleaning device 35, 35' are arranged on both sides of the print substrate web 12 in order to smooth the print images on both sides of the print substrate and, if applicable, to clean both smoothing rollers 20, 20' (the respective second element is characterized in Figures with the corresponding reference character and an apostrophe ''').

The smoothing rollers 20, 20' are only cooled by the cool environment air in the region between the fixing station 14 and the smoothing device 17, such that the toner optimally does not adhere to the smoothing rollers 20, 20'. However, no targeted cooling of the print substrate web 12 before the smoothing rollers 20, 20' or a targeted cooling of the smoothing rollers 20, 20' themselves occurs.

Figure 4:
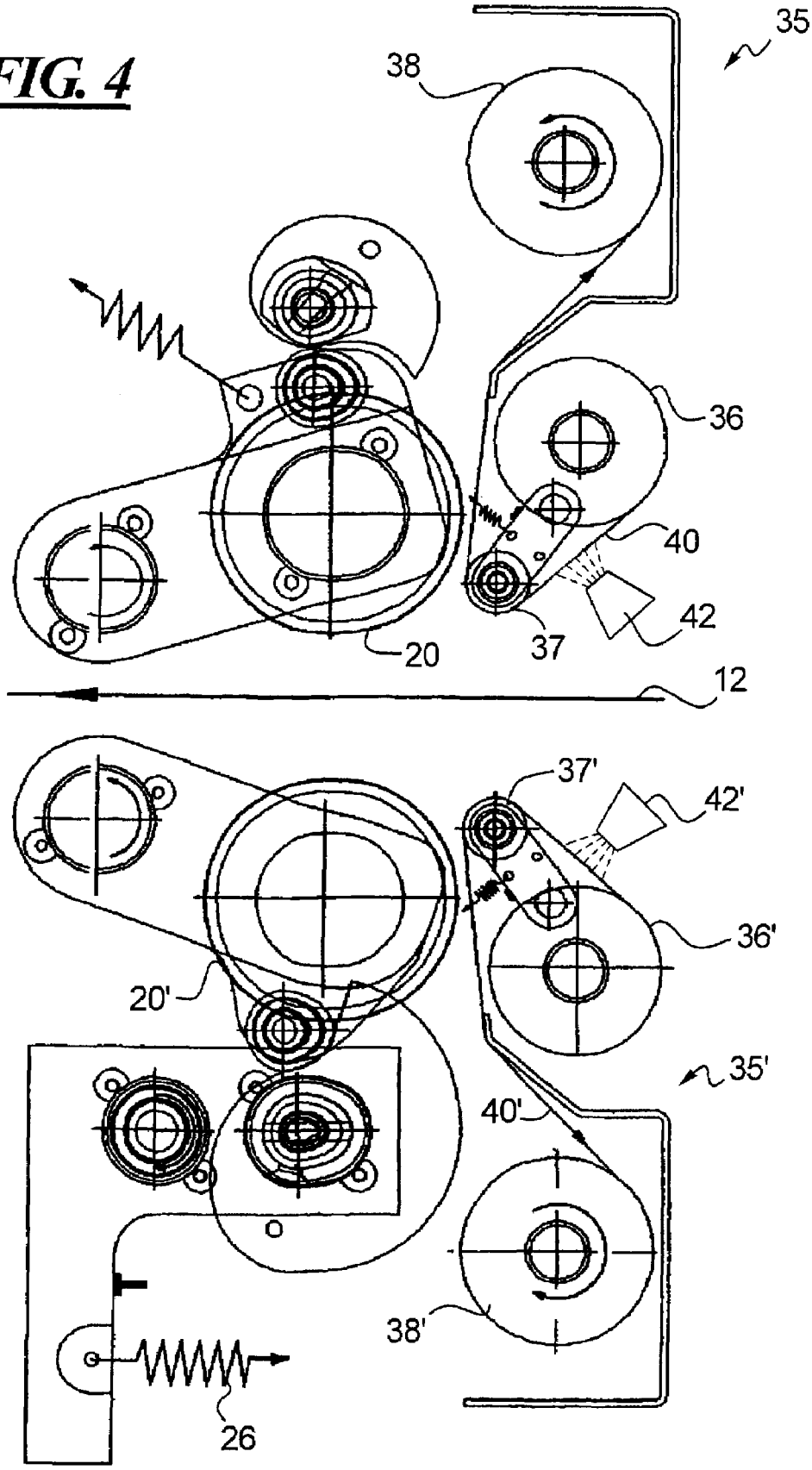
FIG. 4 is a side view of the device according to FIG. 3 in a rest state.

FIG. 4 shows the smoothing rollers 20, 20' in a rest position in which the smoothing rollers 20, 20' are distanced from the print substrate web 12. The smoothing rollers 20, 20' are swung away from the print substrate web 12 via the lifter actuators 30, 30'. Since the print substrate web 12 is not printed in this state, no smoothing is necessary in this state; a cleaning of the smoothing rollers 20, 20' is then also unnecessary.

An optional dampening device 42, 42' is additionally shown in FIG. 4 with which the print substrate web 12 can be dampened as needed. For this, the cleaning belt 40, 40' is advantageously used in that a dampening substance (such as, for example, silicon oil or water) is extracted from a reservoir (not shown) and is applied on the cleaning belt 40, 40'. Since the saturated cleaning belt 40, 40' is guided past the smoothing roller 20, 20', a light dampening film is left behind on its surface.

As a result of this, the cleaning belt 40, 40' is simultaneously a dampening device for the smoothing rollers 20, 20', whereby the dampening substance is transferred onto the smoothing rollers 20, 20' and further onto the print substrate. This has the advantage that the smoothing and the dampening occurs simultaneously in one station.

The cleaning devices 35, 35' are thereby only cleaned in the operating state in effective connection with the smoothing rollers 20, 20', but not in the rest state. A cleaning in the rest state is not necessary.

When the smoothing rollers 20, 20' are dampened, it is advantageous when the saturated cleaning belt 40, 40' does not rest on the smoothing rollers 20, 20' in the rest state (when the smoothing rollers 20, 20' no longer rotate). This prevents a thicker oil film or other unwanted deposits of dampening substance (such as oil spots) on the surface of the smoothing rollers 20, 20' which would lead to an impaired print image 21. This can be executed at the beginning of the rest state, on the one hand via pivoting of the smoothing rollers 20, 20' and via pivoting of the cleaning devices 35, 35'.

From the rest state, the smoothing rollers 20, 20' arrive in the operating position in that initially the upper smoothing roller 20 and then the lower smoothing roller 20' are swung into the operating position. A sufficiently-high abrasion effect is created by the corresponding pressure force of the smoothing rollers 20, 20' so that the smoothing rollers 20, 20' are towed along by the print substrate web 12 without their own rotation actuation.

FIG. 5 shows a further exemplary embodiment in which the pre-stress springs 26 between the pre-stress levers 32 are replaced by two springs 26', 26" with the same overall rigidity. The two springs 26', 26" are connected with the adjustment element 27 (for example a linear motor) that allows a movement in the longitudinal direction of the spring. If the edge position of the print substrate web 12 is now monitored via a sensor, the pressure of the smoothing rollers 20, 20' can be varied via movement of the adjustment element 27 on the one or other edge side of the smoothing rollers 20, 20' and an asymmetrical surface pressing can thereby be achieved across the paper width. Since the moved print substrate web 12 tends to wander in the direction of the higher pressure, the edge position of the print substrate web 12 can thus be regulated within narrow limits.

Figure 6:
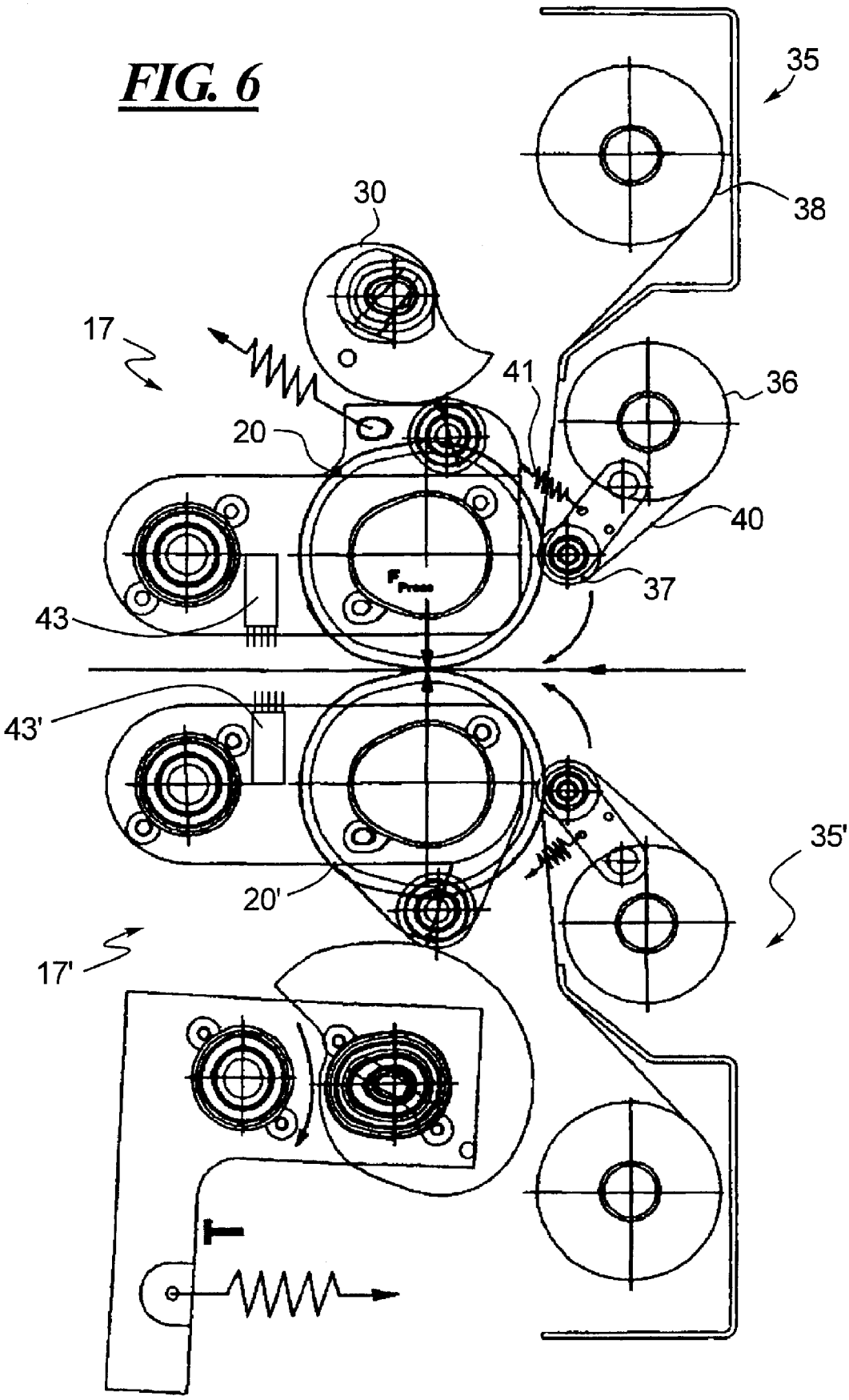
FIG. 6 shows a side view of the device according to FIG. 3 with discharge brushes for electrostatic discharging of the smoothing rollers and the print substrate web.

A further exemplary embodiment is shown in FIG. 6, in which passive discharge brushes 43, 43' that simultaneously decrease charge from the print substrate and from the roller surface of the smoothing rollers 20, 20' are fastened between the pivot arms 28, 28'. The electrostatic charges are created throughout the transport of the print substrate web 12 between the two smoothing rollers 20, 20' upon movement of the electrically-insulated smoothing rollers away from the print substrate web 12. EMC interferences are reduced by the discharging and a protection from electrostatic discharge upon contact with these parts exists for the operator/client service.

Figure 7:
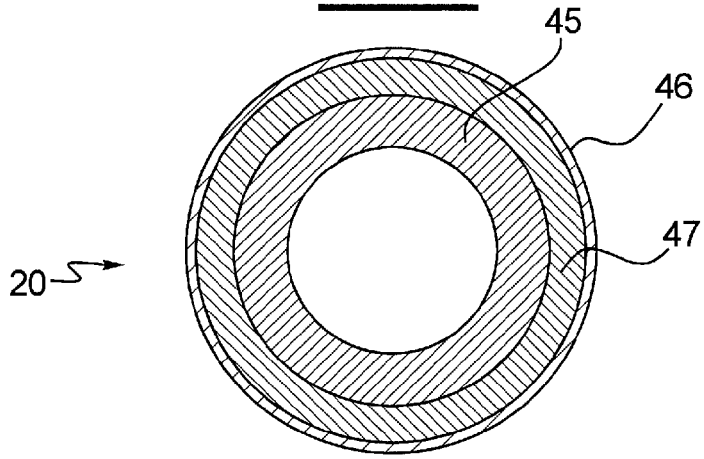
FIG. 7 shows a section through a smoothing roller.

FIG. 7 shows a section through a smoothing roller 20, 20' that comprises an inner, hard solid or hollow-cylindrical core 45 (for example made from steel), an optional, soft intermediate layer 46 and an outer circumference as a hard outer layer 47. The hard outer layer 47 is, for example, manufactured from a fluoropolymer such as PFA (also designated as shrink tubing) or from a metallic alloy such as, for example, a chromium-nickel alloy. . The soft intermediate layer 46 can, for example, be produced from silicon.

The thin outer layer 47 exhibits a good heat conduction behavior so that the temperature of the outer layer 47 is approximately the same across the entire generated cylinder surface. When the outer layer 47 exhibits a good heat conductivity, the core 45 in contrast has a very poor heat conductivity; the smoothing roller thus reaches a stable temperature value faster on its generated cylinder surface. In contrast to this, if the entire smoothing roller were to exhibit a too-high heat capacity and a good heat conductivity towards the core 45, the smoothing roller would take too much temperature from the print substrate and thus would unacceptably cool the toner. A smoothing would then no longer be completely or possible or would be insufficiently possible. In order to simply solve this problem, on the outer layer 47 of the smoothing roller 20, 21 possesses good thermal conductivity. When the core 45 likewise possesses good thermal conductivity, the intermediate layer 46 is thus required as a heat insulation towards the core 45. Due to this specifically-present thermal behavior, the print image 21 is always smoothed under the same conditions (temperature).

Due to the low heat transfer from the outer layer 47 to the core 45 and the thin outer layer 47 that represents only a slight heat capacity, the outer layer 47 cools somewhat in the rest state of the smoothing roller 20, 20'. In the operating state, it also quickly arrives at the operating temperature again due to the hot toner. However, heat is temporarily withdrawn from the print substrate web 12 and the hot toner shortly after the run-in into the operating state. In order to prevent this, in the rest position the smoothing roller 20, 21' can be pre-heated by a heating device (compare FIGS. 8 through 10).

Relative to the warm toner, the outer layer 47 exhibits a distinctly higher hardness. The entire coating compound of the smoothing roller 20, 20' thus exhibits a System-Shore hardness A greater than approximately 75 AS. The core 45 is adapted in terms of its material hardness and the outer layer 47 is adapted in terms of its thickness so that the print character of the print image 21 is completely leveled over a typical length, and irregularities in the print substrate thickness or the toner application are thereby compensated.

Macroscopically, the printed character should be maintained in terms of its shape (outer dimensions); merely the microscopic unevenness should be smoothed. This means that the visible basic shape of the printed character should not be changed; the outer appearance of the print image 15 is thus not changed via smoothing and leveling. Only the surface of the toner is smoothed in terms of its profile and the toner is compressed overall by the smoothing and compression. The outer layer 47 should therefore be hard relative to the toner; and the optional intermediate layer 46 should be soft enough in order to generate a sufficiently large nip (contact surface of the smoothing roller 20, 20' on the print substrate web 12).

Each smoothing roller can be designed slightly convex (or barrel-like=deviation from the circular cylinder shape) in the axial direction to compensate the deflection of the smoothing rollers 20, 20' (these are only borne on the front). A more uniform smoothing thereby results over the width of the print substrate web 12 since the forming pressure in the middle is increased by the convex formation, such that the pressure is uniformly distributed from the outside inwards over the entire length. Otherwise, the pressure would be highest on the outside near the bearing, due to the deflection of the smoothing roller 20, 20'.

With specific print substrates, a concave execution of the smoothing rollers 20, 20' can also advantageously be utilized in order to improve the running stability of the print substrate. The print substrate web 12 is thereby drawn and tensed at the points with the highest forming pressure. The print image 21 and the running stability of the print substrate can also thereby be improved when alternating convex and concave regions are designed in at least one smoothing roller 20, 20'.

Figure 8:
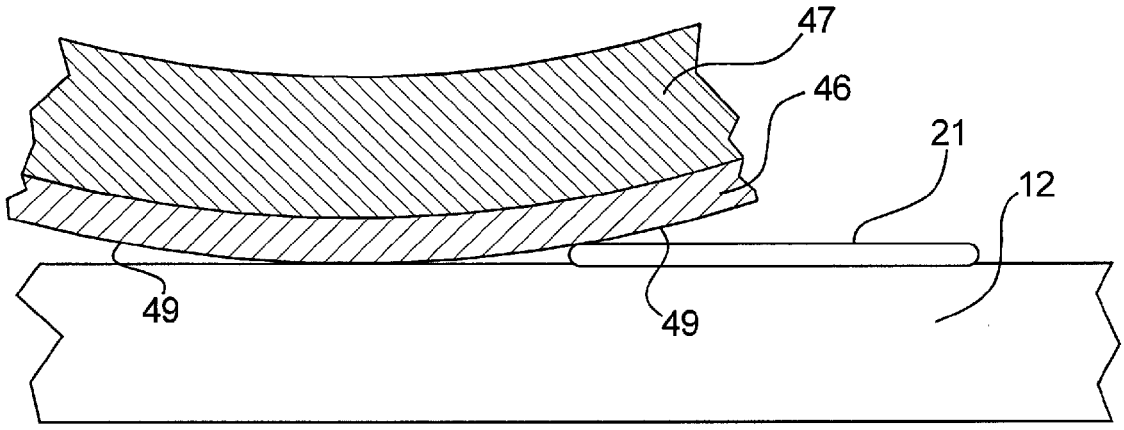
FIG. 8 illustrates a section from a smoothing roller with a structured generated surface.

An exemplary embodiment for the smoothing roller 20, 20' is shown in FIG. 8, in which the thin outer layer 47 is additionally provided on its outer surface with a two-dimensional or three-dimensional microstructure 49. The microstructure 49 can exhibit a spatial "peak-and-valley structure" with a characteristic formation of "elevations" and "depressions" as microstructure elements. Upon smoothing, this microstructure 49 generates an image map pressed into the toner via which the gloss of the print image can be specifically varied by the engrained structure. The dimensions of the microstructure elements in the tangential direction are distinctly smaller than a typical length or minimal dimensions of a single print point. When the smallest print point at a resolution of 600 dpi has a diameter of approximately 40 μm, a microstructure should still have a smaller dimension.

The depth of the microstructure 49 is selected so that a piercing of the toner layer through to the print substrate web 12 is prevented. The transition from one microstructure element to the next should run in a flowing manner in order to not adulterate the print image 21. The advantage of this microstructure 49 is that the dampening agent can collect and be retained as a gliding structure in the depressions of the toner, whereby a lasting reduction of the abrasion of the print image 21 is provided for.

The geometry of the microstructure 49 can be engrained only in the circumferential as well as axial directions of the smoothing rollers 20, 20'; however, better still is a two-dimensional microstructure 49 along the generated cylinder surface (i.e. three-dimensional in the axial, radial and circumferential directions) of the smoothing rollers 20, 20'. The microstructure 49 is advantageously equipped with a sliding transition from a recess to a depression, similar to a sine wave. In the simplest case, the intervals (periods) between two adjacent elevations are constant in order to ensure an easier manufacturing capability. An improvement of the optical impression via prevention of Moire patterns can be achieved via a random or irregular distribution of the intervals of the structure elements within a tolerance limit. It thus remains important to leave the maximum interval of adjacent elevations within the aforementioned limits (distinctly smaller than the smallest image point).

Figure 9:
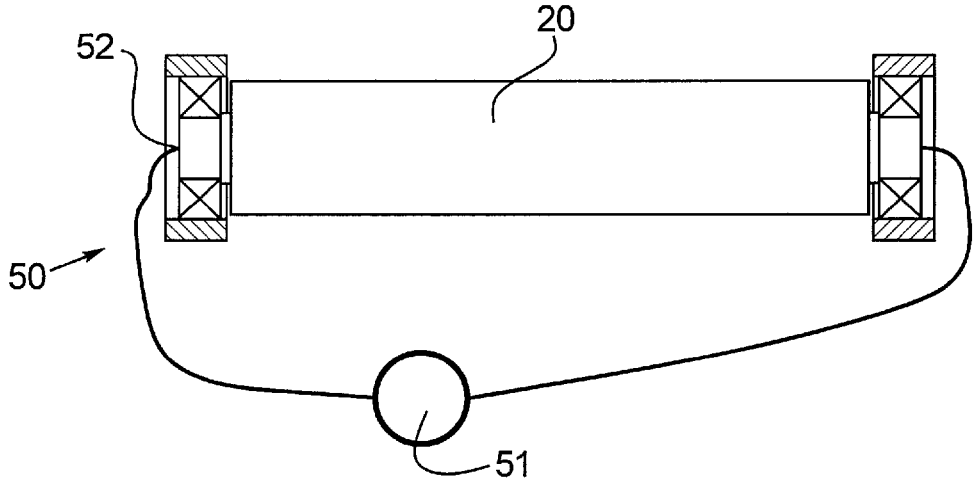
FIGS. 9 through 11 illustrate exemplary embodiments of heating devices for heating of the smoothing roller.
Figure 10:
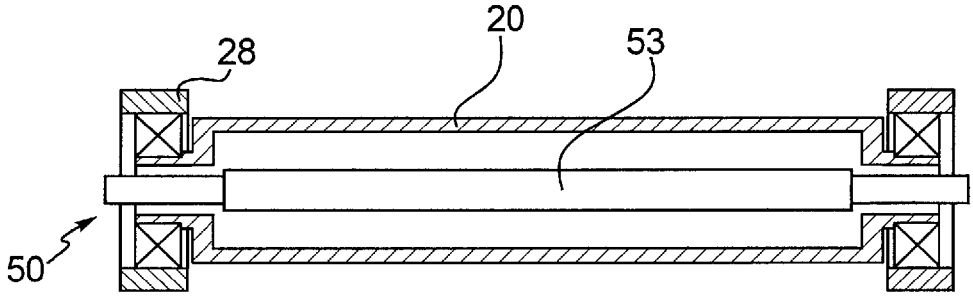

Various exemplary embodiments for the heating device via which a smoothing roller 20, 20' can be heated in the rest state are shown in FIGS. 9 through 10. The surface of the smoothing roller 20, 20' is thus preheated to a largely constant temperature before the smoothing roller 20, 20' is pressed against the print substrate web 12. The heating is ended upon pivoting of the smoothing rollers 20, 20' into the operating state. The surface is thus already at the operating temperature and draws no additional heat away from the toner on the print substrate web 12. Smoothing, compression, dampening and structuring can thus occur uniformly along the belt from the start.

According to FIG. 9, the smoothing roller 20, 20' can be electrically heated with the aid of a current source 51. In the axial direction, the smoothing roller 20, 20' exhibits a predetermined forward resistance through which the current flows and thus heats the smoothing roller 20, 20'. In order to let the current flow be conducted only through the smoothing roller 20, 20', in the region of the bearing on the edge sides the smoothing roller 20, 20' comprises an electrical insulation relative to the pivot arms 28, 29. The smoothing roller 20, 20' is electrically connected with the current-source 51 via sliding contacts 52. As a result of this, the electrical contacts 52 do not prevent the rotation of the smoothing rollers 20, 20' in the operating state, even when the smoothing rollers 20, 20' are not heated. When the electrical resistance along the smoothing roller 20, 20' is homogeneously designed, the temperature uniformly distributes over the entire outer surface so that barely any temperature differences occur in the axial direction that would then cause a non-uniform smoothing later.

A contact-less inner heating of the smoothing roller 20, 20' is shown in FIG. 10 as a heating device 50 that can, for example, be designed as an IR heat radiator 53.

Figure 11:
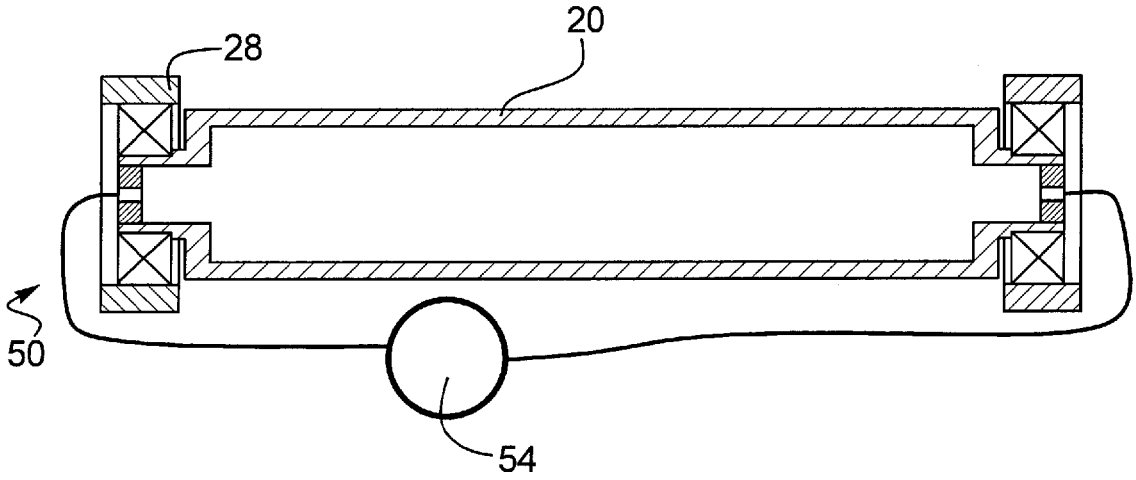

A flow heater 54 in which the smoothing roller 20, 20' is heated by a fluid 55 flowing along the roller axle is shown in FIG. 11 as a heating device 50.

Via the heating, the smoothing roller 20, 20' is already brought to the operating temperature before the start of the printing. The toner is thus not too severely cooled at the start and can be uniformly smoothed by the smoothing roller 20, 20'.

If toner transferred onto the print substrate web 12 is fixed in a fixing station by means of infrared radiation, the toner is heated to a fixing temperature of approximately 100° C. to approximately 200° C. The smoothing subsequently occurs at an only slightly lower temperature since the toner cools only negligibly on the short stretch between the fixing station 14 and the smoothing rollers 20, 20'. However, in the smoothing device 17 the temperature of the toner must still be distinctly above the glass transition temperature so that the unwanted "toner mountains" can be smoothed. Not only are the peaks of the toner thus flattened, but rather the entire surface of the toner is leveled and the toner is compressed.

It is advantageous to dampen the print substrate simultaneously with the smoothing and to also impress a structure on the print substrate in order to specifically alter the gloss. However, the toner image may not be specifically cooled between fixing station 14 and smoothing device 17 since otherwise the toner cannot be sufficiently smoothed. The abrasion would then be too great in the later process and the print image 21 would be worsened. A cooling blower that is necessary in the prior art before the gloss generator there is therefore not required by the device of the preferred embodiment. A specific cooling of the smoothing rollers is likewise not desired.

The surface of the print image 21 is compressed by the smoothing so that a later abrasion is largely prevented. For the preferred embodiment, it is utilized that the toner is heated in the fixing station and is still hot and exhibits a doughy structure immediately afterwards.

The fixing temperature is regulated by means of the controllers of the fixing heat power so that the toner temperature is largely constant in the region of the smoothing device 17. A uniform temperature of the toner in the region of the smoothing device 17 thus results. The toner can thus be smoothed more uniformly across the entire print image 21 along the print substrate web 21 since then it is always smoothed given largely equal temperature relationships.

A more uniform smoothing of the print image likewise results in that gases, dust and moisture as well as water vapor are drawn off before the smoothing device 17. Interfering particles such as dust particles or condensed water can not settle on the print image 21 and negatively influence the smoothing event. Since the hot air suction 22 only insignificantly influences the temperature of the toner, the toner still remains hot enough in order to be efficiently smoothed in the smoothing device 17. However, when unwanted particles scarcely occur at the end of the fixing station 14 anyway, the hot air suction 22 is be entirely omitted.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A device for post-processing of a print substrate web printed by an electrographic printing or copying device, comprising:

a smoothing device arranged in immediate proximity after a fixing device in a feed direction of the print substrate web;

the smoothing device substantially pressing toner flat with a predetermined pressure;

the smoothing device comprising a cleaning device in order to remove dirt particles still located on the smoothing device; and the cleaning device comprising a dampening device via which a dampening substance is supplied to the print substrate via the smoothing device.

2. A device according to claim 1 wherein the toner is heated solely by the fixing device.

3. A device according to claim 1 wherein the cleaning device is simultaneously a dampening device that comprises a cleaning belt that is saturated with the dampening substance, the cleaning belt gliding along a surface of the smoothing device to be cleaned and dampened and thereby applying a dampening film thereto.

4. A device according to claim 1 wherein a suction device is arranged between the fixing device and the smoothing device.

5. A device according to claim 1 wherein the smoothing device comprises at least two approximately cylindrical smoothing rollers arranged approximately parallel to one another and close to one another between which the print substrate is directed so that both a front side and a back side of the print substrate is in contact with a respective smoothing roller.

6. A device according to claim 5 wherein a cleaning device is associated with each smoothing roller.

7. A device according to claim 6 wherein the cleaning device comprises at least one guide roller that guides a cleaning belt and elastically presses against the smoothing roller.

8. A device according to claim 1 wherein the smoothing device comprises at least one substantially cylindrical smoothing roller that internally comprises a hard solid or hollow cylindrical core, and externally a hard outer layer.

9. A device of claim 8 wherein the roller comprises a soft intermediate layer over the core and between the core and the hard outer layer.

10. A device according to claim 8 wherein the outer layer with its outer surface is structured two-dimensionally or three-dimensionally with a microstructure in order to engram an image into the toner surface upon smoothing.

11. A device according to claim 8 wherein the smoothing roller is designed as at least one of cylindrical, slightly convex, or slightly concave.

12. A method of claim 11 including the step of heating the toner solely by the fixing device.

13. A method of claim 11 wherein a suction device is arranged between the fixing device and the smoothing device.

14. A device according to claim 1 wherein at least one of the smoothing device or a cleaning device associated with each smoothing roller comprises a pivot device that brings the cleaning device out of effective connection with the smoothing device.

15. A device for post-processing of a print substrate web printed by an electrographic printing or copying device, comprising:

a smoothing device arranged in immediate proximity after a fixing device in a feed direction of the print substrate web;

the smoothing device substantially pressing toner flat with a predetermined pressure;

the smoothing device comprising a cleaning device in order to remove dirt particles still located on the smoothing device; and the cleaning device being simultaneously a dampening device that comprises a cleaning belt that is saturated with the dampening substance, the cleaning belt gliding along a surface of the smoothing device to be cleaned and dampened and thereby applying a dampening film thereto.

16. A method for post-processing of a print substrate web printed by an electrographic printing or copying device, comprising the steps of:

arranging a smoothing device in immediate proximity after a fixing device in a feed direction of the print substrate web;

providing the smoothing device with a cleaning device in order to remove dirt particles still located on the smoothing device, the cleaning device comprising a dampening device via which a dampening substance is supplied to the print substrate via the smoothing device;

with the smoothing device substantially pressing a toner flat with a predetermined pressure; and with the cleaning device removing the dirt particles still located on the smoothing device and supplying the dampening substance to the print substrate.

* * * * *